US006037961A

United States Patent [19]

Saito et al.

[11] Patent Number: 6,037,961

[45] **Date of Patent: *Mar. 14, 2000**

[54] THERMAL PRINTING METHOD AND THERMAL PRINTER

[75] Inventors: Hitoshi Saito; Tomoyoshi Nishimura, both of Saitama, Japan

[73] Assignee: Fuji Photo Film Co., Ltd., Kanagawa, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/763,116

[22] Filed: Dec. 10, 1996

[30] Foreign Application Priority Data

| | | | |
|---|---|---|---|
| Dec. 12, 1995 | [JP] | Japan | 7-323311 |
| Jul. 17, 1996 | [JP] | Japan | 8-187554 |
| Oct. 24, 1996 | [JP] | Japan | 8-282332 |

[51] Int. Cl.[7] ..... B41J 2/38

[52] U.S. Cl. ..... 347/185; 347/186

[58] Field of Search ..... 347/172, 175, 347/185, 186, 187, 211; 400/120.08

[56] References Cited

U.S. PATENT DOCUMENTS

| | | | |
|---|---|---|---|
| 5,216,438 | 6/1993 | Nakao et al. | 347/172 |
| 5,625,394 | 4/1997 | Fukuda et al. | 347/175 |

FOREIGN PATENT DOCUMENTS

| | | | |
|---|---|---|---|
| 2-538A | 1/1990 | Japan | B41J 2/38 |
| 2-88253 | 3/1990 | Japan | 2/38 |
| 4-220360 | 8/1992 | Japan . | |
| 5-261954 | 10/1993 | Japan . | |

*Primary Examiner*—N. Le
*Assistant Examiner*—Anh T. N. Vo
*Attorney, Agent, or Firm*—Birch, Stewart, Kolasch & Birch, LLP

[57] ABSTRACT

A thermosensitive recording sheet is conveyed relative to a thermal head. To effect thermal recording, the thermal head applies heat energy to the recording sheet. The recording sheet is preheated with preheating energy shortly before recording of the recording sheet with the thermal head. The preheating energy is lower than enough to color the recording sheet, but heightens temperature of the recording sheet upon movement of the recording sheet to the thermal head. The heat energy to be applied by the thermal head is reduced according to the preheating energy.

19 Claims, 8 Drawing Sheets

THERMAL PRINTING METHOD AND THERMAL PRINTER

BACKGROUND OF THE INVENTION

1. Field of the Invention

The present invention relates to a thermal printing method and thermal printer for thermal recording of an image to a thermosensitive recording material. More particularly, the present invention relates to a thermal printing method and thermal printer capable of high-speed printing while a recording surface of the recording material is prevented from being damaged.

2. Description Related to the Prior Art

There are widely used thermal printers including a direct thermal printer in which thermosensitive recording material is heated for directly printing an image. The color thermosensitive recording material or recording sheet adapted to the direct printing is constituted by a support and thermosensitive coloring layers of magenta, yellow and cyan which are formed on the support. Selectively to develop colors of the coloring layers, the coloring layers are different in thermal sensitivity. A superficial one of the coloring layers, located with a recording surface of the recording sheet, has the highest thermal sensitivity. The coloring layers have lower thermal sensitivity according to the closeness to the support. Amounts of heat energy applied to the recording material are controlled, to color the coloring layers differently in coloring density.

To print a full-color image, the recording material is moved while a thermal head is pressed against the same and generates heat. At first a yellow image is recorded one line after another by coloring the yellow coloring layer. Immediately after the yellow recording, near ultraviolet rays peaking at 420 nm are applied to the recording material, to fix the yellow coloring layer. Then a magenta image is recorded one line after another by coloring the magenta coloring layer. Immediately after the magenta recording, ultraviolet rays peaking at 365 nm are applied to the recording material, to fix the magenta coloring layer. Finally a cyan image is recorded by coloring the cyan coloring layer.

It is conceived to heighten printing speed in a thermal printer. For example it is conceived to convey the recording material at a high conveying speed of 16 mm/sec during the printing. To obtain the coloring density obtainable according to conventional printers, the thermal head is required to apply the heat energy in a shortened period to the recording material. In the case of coloring the cyan coloring layer the closest to the support nearly at the maximum density, the heat energy applied by the thermal head to the recording material is so high that the thermal head has high temperature. There occurs thermal roughening on the recording surface of the recording material. The thermal roughening consists of small bubbles created in a protective layer of the recording material covering the yellow coloring layer due to the contact with the thermal head. The thermal roughening lowers gloss of the recorded image on the recording surface to degrade the image quality, and lowers the coloring density of the printed image because the bubbles whiten the protective layer.

Also, water vapor is likely to emerge from the cyan coloring layer due to the high temperature of the thermal head in contact with the recording material. The vapor is accumulated between the support and the cyan coloring layer to create "blisters" which are comparatively greater than the surface bubbles. The blisters damage the appearance and quality of the recording material in addition to the decrease of the coloring density of the printed image. There is no prior technique capable of reliably minimizing the decreases in the gloss and/or the coloring density.

SUMMARY OF THE INVENTION

In view of the foregoing problems, an object of the present invention is to provide a thermal printing method and thermal printer in which a recording surface of the recording material is prevented from being thermally damaged even in the high-speed printing.

In order to achieve the above and other objects and advantages of this invention, a thermosensitive recording material is preheated with preheating energy shortly before recording of the recording material with a thermal head, the preheating energy being lower than enough to color the recording material, but adapted to heightening temperature of the recording material upon movement of the recording material to the thermal head, in which heat energy to be applied by the thermal head is reduced according to the preheating energy.

Specifically, the recording material is conveyed along a conveying path, and preheated in a preheating station disposed upstream from the thermal head.

In a preferred embodiment, the recording material has a back surface reverse to the recording surface, and the back surface is preheated. In other words, one side of the recording material is the recording surface, and the opposite side, or reverse side, is the back surface.

In a variant, the recording surface is preheated.

The preheating step causes the recording surface to have surface temperature Ts upon relative movement of the recording material to the thermal head, the surface temperature Ts meeting:

$$t1-t2 \leqq Ts \text{ and } Tr \leqq Ts;$$

where t1 is temperature of the recording surface for coloring the recording material at maximum density thereof without the preheating step;

t2 is temperature of the recording surface at which the recording surface is thermally damaged; and Tr is room temperature.

To be precise, the recording material includes a support and at least first, second and third thermosensitive coloring layers arranged on the support and colorable in different colors, the first coloring layer is disposed with the recording surface of the recording material and has a highest thermal sensitivity, and the third coloring layer is disposed close to the support and has a lowest thermal sensitivity, the thermal head applies heat energy to the first, second and third coloring layers. The recording material is preheated with the preheating energy shortly before at least recording of the third coloring layer with the thermal head, the preheating energy being lower than enough to color the third coloring layer, but adapted to heightening temperature of the third coloring layer upon movement of the recording material to the thermal head, in which the heat energy to be applied by the thermal head is reduced according to the preheating energy.

In accordance with the present invention, the recording surface of the recording material is prevented from being thermally damaged even in the high-speed printing.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENT(S) OF THE PRESENT INVENTION

Figure 1:
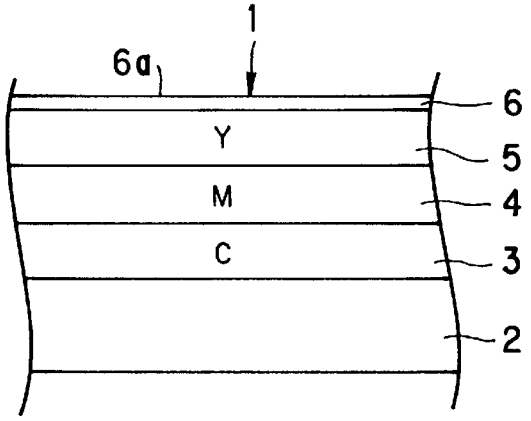
FIG. 1 is an explanatory view in cross section, illustrating a layered structure of thermosensitive recording sheet.

In FIG. 1 illustrating a layered structure of a color thermosensitive recording sheet 1, the recording sheet 1 includes a support 2, a cyan coloring layer 3, a magenta coloring layer 4, a yellow coloring layer 5 and a protective layer 6 disposed in the order listed. The magenta coloring layer 4 has photochemical fixability responsive to ultraviolet rays of a wavelength range of nearly 365 nm. The yellow coloring layer 5 has photochemical fixability responsive to near ultraviolet rays of a wavelength range of nearly 420 nm. Recording operation is effected in the order from an obverse surface or recording surface toward the support 2, namely yellow, magenta and cyan. It is also possible to use an alternative recording sheet including the support 2, the cyan coloring layer 3, the yellow coloring layer 5, and the magenta coloring layer 4 disposed in the order listed. With this recording sheet, recording operation is effected in the order magenta, yellow and cyan. There are intermediate layers which are disposed between the coloring layers 3–5 for adjusting thermal sensitivity of the coloring layers 3–5, but which are not shown in the drawing.

Figure 2:
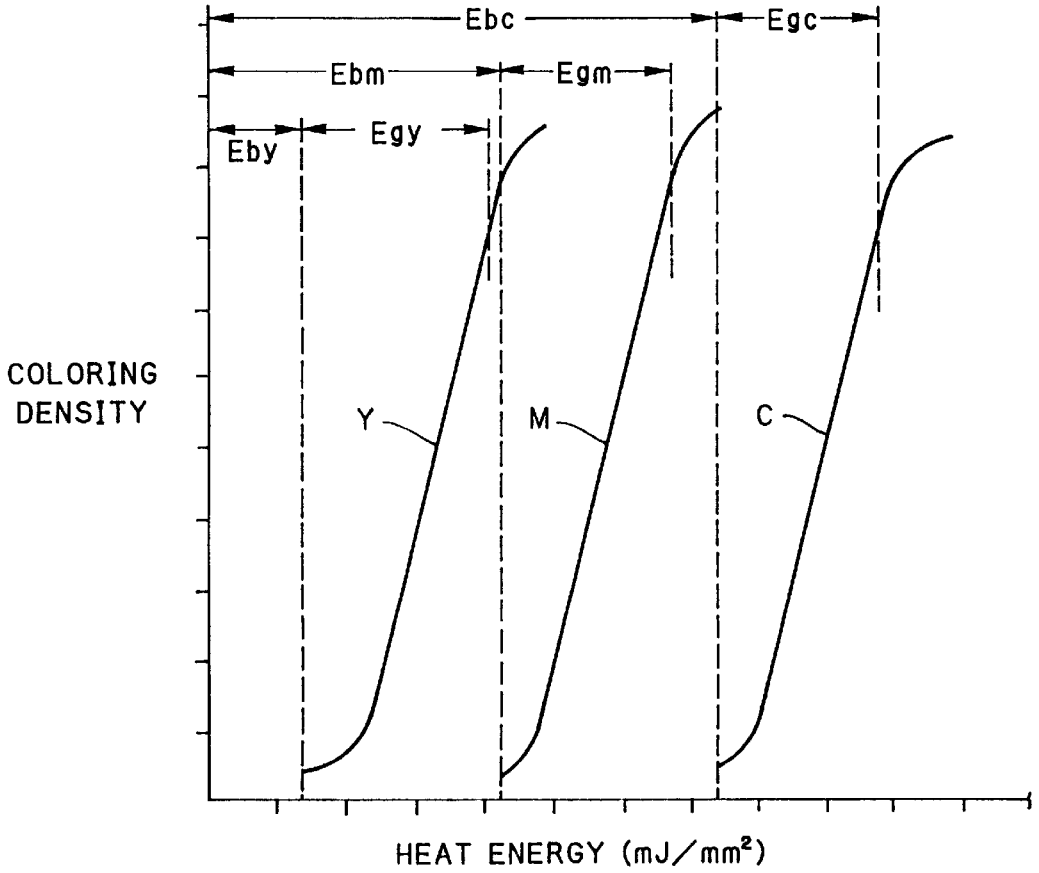
FIG. 2 is a graph illustrating coloring characteristics of the recording sheet.

FIG. 2 illustrates coloring characteristics of the coloring layers 3–5. Higher heat energy is required for coloring the coloring layers 3–5 according to the closeness to the support 2. The highest heat energy is required for the cyan coloring layer 3. The lowest heat energy is required for the yellow coloring layer 5. In other words, the yellow coloring layer 5 has the highest thermal sensitivity. The cyan coloring layer 3 has the lowest thermal sensitivity.

To record a yellow pixel thermally, heat energy is applied to the recording sheet 1 as a sum of bias heat energy Eby for yellow and image heat energy Egy for yellow. The bias heat energy Eby has an amount slightly short of causing the yellow coloring layer 5 to develop the yellow color, and is applied to the recording sheet 1 during the bias heating at the beginning of recording each one pixel. The image heat energy Egy has an amount determined according to the gradation level of yellow, namely yellow coloring density of a pixel to be printed, and is applied to the recording sheet 1 during the image heating which succeeds the bias heating. Similarly the bias heating and the image heating are effected by applying magenta bias heat energy Ebm, magenta image heat energy Egm, cyan bias heat energy Ebc and cyan image heat energy Egc.

Figure 3:
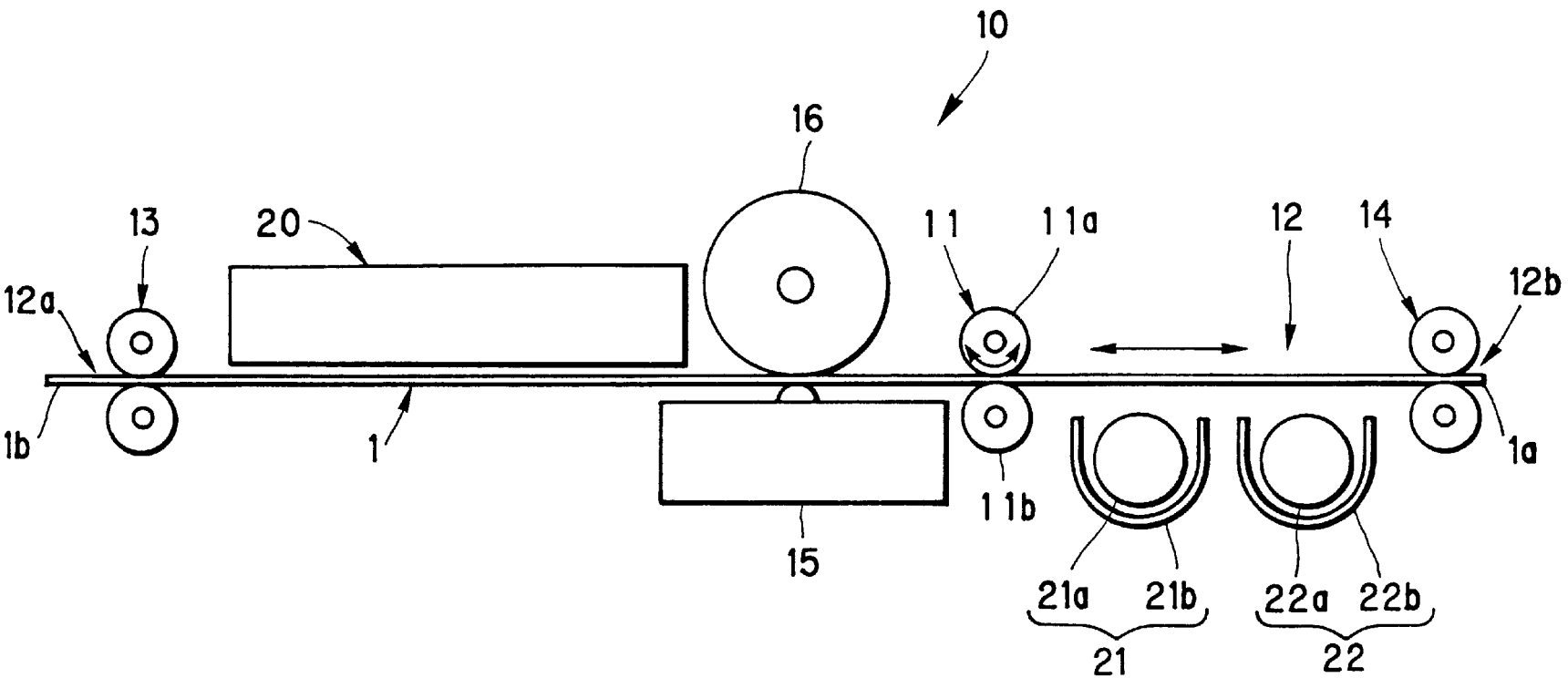
FIG. 3 is an explanatory view in elevation, schematically illustrating a color thermal printer.

FIG. 3 schematically illustrates a color thermal printer 10, which incorporates conveying rollers 11 including a capstan roller 11a and a pinch roller 11*b*. The recording sheet 1 is conveyed by the conveying rollers 11 along a conveying path 12 back and forth in a straight direction. During the conveyance a printing thermal head 15 records the yellow, magenta and cyan images to the recording sheet 1 in a three-color frame-sequential manner. At a left end of the conveying path 12 as viewed in FIG. 3, there is an entrance 12*a* for feeding of the recording sheet 1. At the entrance 12*a* are disposed a pair of feeding rollers 13. The recording sheet 1 is fed out of a sheet supply cassette (not shown), nipped by the feeding rollers 13, and conveyed to a recording position. At a right end of the conveying path 12 as viewed in FIG. 3, there is an exit 12*b* for removal of the recording sheet 1. At the exit 12*b* are disposed a pair of exit rollers 14. The recording sheet 1 exits from the exit 12*b* toward a receptacle tray (not shown) for receiving the recording sheets 1 collectively one on another.

The thermal head 15 is disposed in the position upstream from the conveying rollers 11, and includes a great number of heating elements which are known in the art and arranged in a main scanning direction which is crosswise to the recording sheet 1. There is a platen roller 16 confronted with the thermal head 15. A plate-shaped heater 20 is disposed between the feeding rollers 13 and the thermal head 15 and near to the thermal head 15, and incorporates a heating element such as Nichrome wire. The plate-shaped heater 20 is a preheating device for preheating the recording sheet 1 before the start of the cyan recording.

There are a yellow fixing optical device 21 and a magenta fixing optical device 22 between the conveying rollers 11 and the exit rollers 14. The yellow fixer 21 is consists of a near ultraviolet lamp 21*a* and a reflector 21*b*. The near ultraviolet lamp 21*a* emits near ultraviolet rays peaking at a wavelength of approximately 420 nm. The magenta fixer 22 is consists of an ultraviolet lamp 22*a* and a reflector 22*b*. The ultraviolet lamp 22*a* emits ultraviolet rays peaking at a wavelength of approximately 365 nm.

The plate-shaped heater 20 is driven before the cyan coloring layer 3 starts being heated for the recording, and comes to have temperature lower than enough to color the cyan coloring layer 3, for example 100–140° C. The plate-shaped heater 20 heats the recording sheet 1 on the side of the support 2 or a back surface. The preheating is effected after photochemical fixation of the yellow coloring layer 5 and the magenta coloring layer 4, and does not cause the yellow coloring layer 5 or the magenta coloring layer 4 to develop color.

When the cyan coloring layer 3 is recorded with the thermal head 15, a cyan image is recordable with reduced heat energy smaller by remaining heat provided by preheating of the recording sheet 1 with the plate-shaped heater 20. The thermal head 15 does not have so high temperature as to damage a recording surface 6*a* of the recording sheet 1 or to roughen the recording surface 6*a* thermally. Note that there is a short time lag between the preheating and main heating at the thermal head 15 because of the conveyance of a recording region on the recording sheet 1. It is inevitable that heat supplied by the preheating is partially lost during the time lag. Therefore the thermal head 15 supplies the recording sheet 1 with heat energy as a sum of lost heat energy and the heat energy being set smaller.

Figure 4:
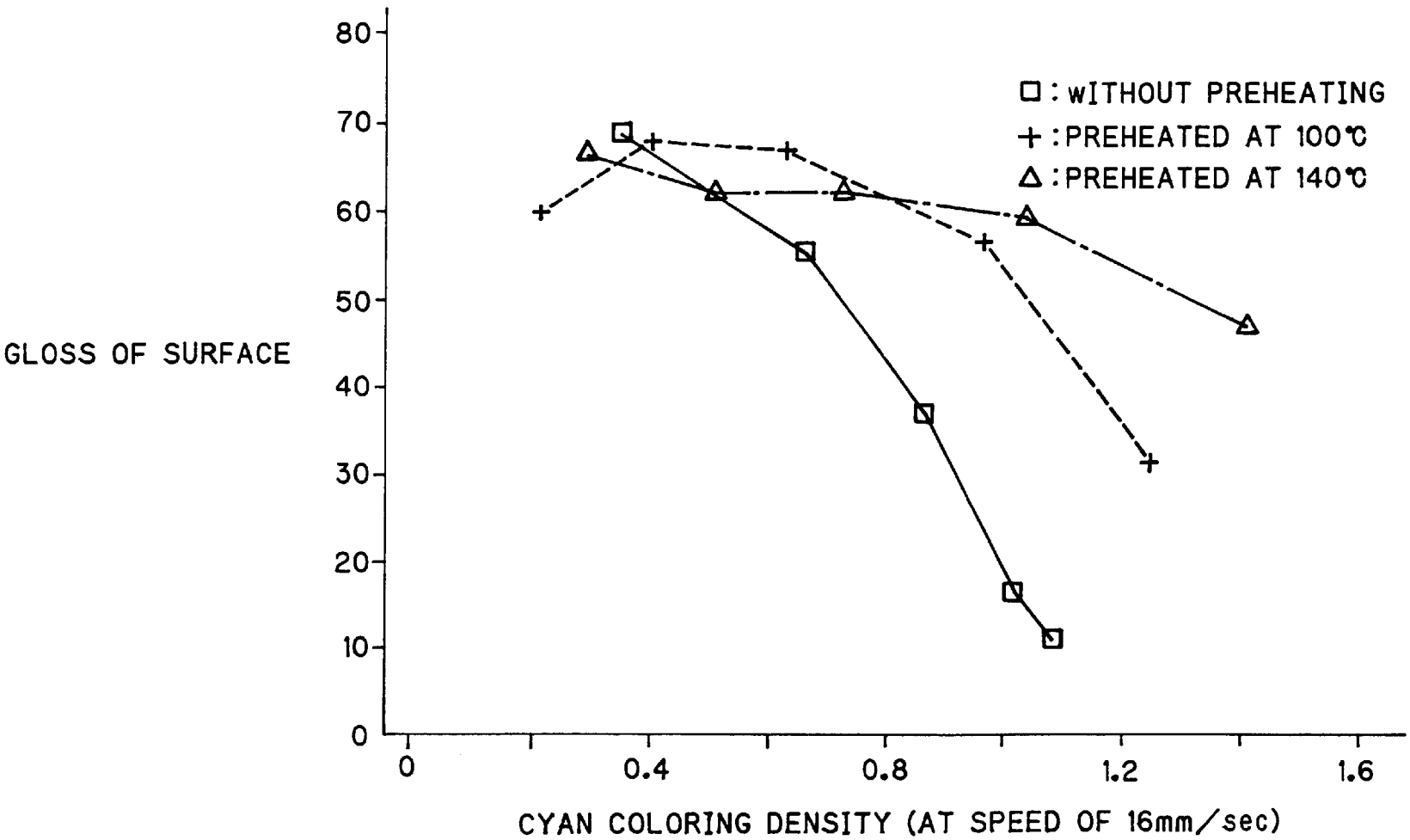
FIG. 4 is a graph illustrating a relationship between gloss of the recording sheet and cyan coloring density.

An experiment was conducted for observing changes in gloss of the recording sheet 1. The plate-shaped heater 20 was driven to have the temperatures of 100° C. and 140° C., before the cyan coloring layer 3 was heated to develop the color. Also the cyan coloring layer 3 was heated to develop the color without having preheated the recording sheet 1 with the plate-shaped heater 20. The gloss of a recording surface 6*a* changed according to changes in the coloring density of the cyan coloring layer 3, and was observed. FIG. 4 is a graph showing results of the experiment. Note that the plate-shaped heater 20 and the recording sheet 1 had an interval of 10 mm between them. It is observed from the graph that, when the recording sheet 1 was not preheated, the gloss of the recording surface 6*a* of the recording sheet 1 was quickly decreased in accordance with the coloring density of the cyan coloring layer 3. Thermal roughening occurred on the recording surface 6*a* of the recording sheet 1.

When the recording sheet 1 was preheated at 100° C. or 140° C., the gloss of the recording surface 6*a* of the recording sheet 1 was decreased only in a slow manner even at a high density of the cyan coloring layer 3. In the case of 140° C., there was very slight decrease in the gloss. It was possible that the amount of bubbles was reduced in the protective layer 6 of the recording sheet 1 by the preheating, and that the thermal roughening on the recording surface 6*a* of the recording sheet 1 was kept low. Also whitening of the protective layer 6 was reduced by the virtue of the reduction of the amount of the bubbles of the protective layer 6. It was possible to keep the image density from being lowered.

Figure 5:
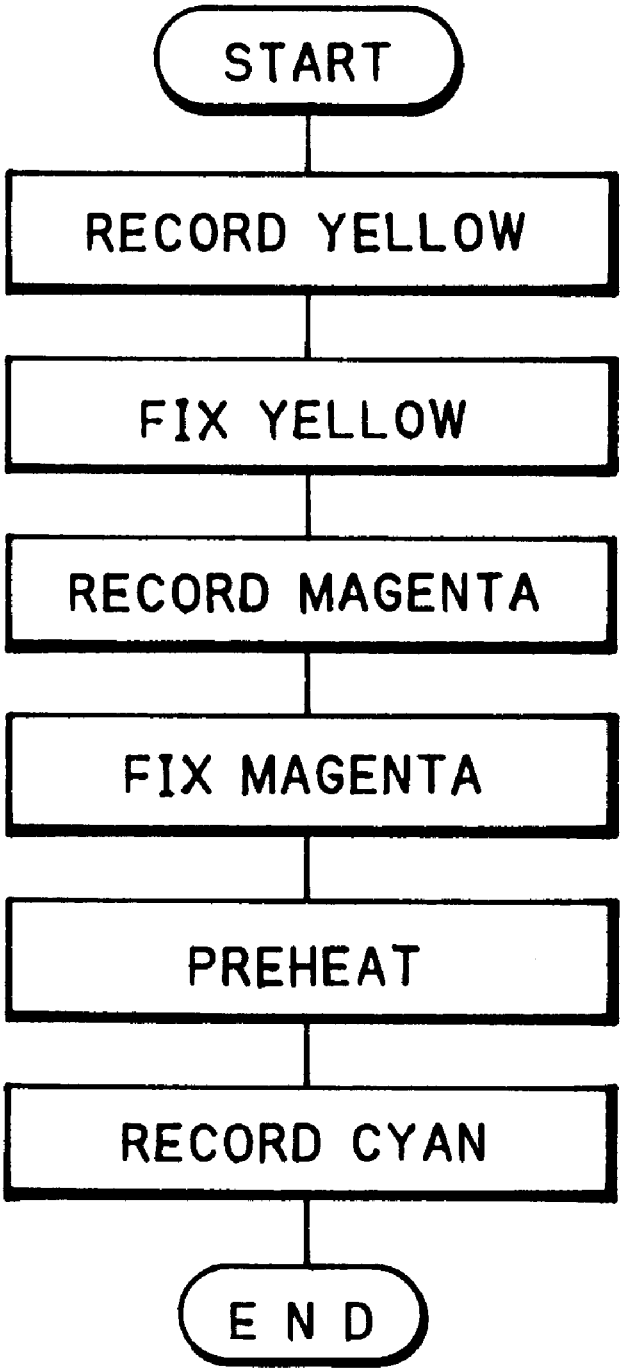
FIG. 5 is a flow chart illustrating a printing process of the thermal printer.

The operation of the color thermal printer is described with reference to FIG. 3 and 5. A great number of recording sheets 1 are contained in the sheet supply cassette with the support 2 or a back surface oriented upwards. An uppermost one of the recording sheets 1 is moved out and fed, so that a front edge 1*a* is entered between the feeding rollers 13. The recording sheet 1 is conveyed through the entrance 12*a* to the thermal head 15 of a recording station by the feeding rollers 13. The plate-shaped heater 20 is not operated during the conveyance.

The front edge 1*a* of the recording sheet 1 moves between the thermal head 15 and the platen roller 16 and to the conveying rollers 11. When the front edge 1*a* is nipped by the conveying rollers 11, the thermal head 15 is pressed against the recording surface 6*a* of the recording sheet 1. The feeding rollers 13 are moved away from one another, to release the recording sheet 1 from being nipped. When a beginning edge of the recording region of the recording sheet 1 comes to the recording position at the thermal head 15, each heating element of the thermal head 15 is driven according to image data of the yellow image. Main heat energy is applied to the recording sheet 1, in combination of the yellow bias heat energy Eby slightly short of coloring the yellow coloring layer 5, and the yellow image heat energy Egy determined by the gradation level of yellow. The yellow image is recorded to the recording sheet 1 line after line. When the yellow recording is started, the near ultraviolet lamp 21*a* of the yellow fixer 21 is driven to emanate near ultraviolet rays. The recording region with the yellow image recorded thereon is moved to a position above the yellow fixer 21. Rays are applied by the yellow fixer 21 to the recording region of the recording sheet 1, to fix the yellow coloring layer 5.

After even an ending edge of the recording region of the recording sheet 1 is subjected to the yellow recording with the thermal head 15, the recording sheet 1 is successively conveyed by the conveying rollers 11, and receives application of the near ultraviolet rays from the yellow fixer 21 for all the recording region. When a rear edge 1*b* of the recording sheet 1 comes to a nip position of the conveying rollers 11, a rotational direction of the conveying rollers 11 is changed over. The recording sheet 1 is conveyed in a backward direction toward the entrance 12*a*. The thermal head 15 has a position away from the recording sheet 1.

When the front edge 1*a* of the recording sheet 1 comes to a nip position of the conveying rollers 11, then a rotational direction of the conveying rollers 11 is changed. When the beginning edge of the recording region comes to the recording position confronted with the thermal head 15, the thermal head 15 is pressed against the recording sheet 1, and operated to start the magenta recording. Then the near ultraviolet lamp 21*a* of the yellow fixer 21 is turned off. The ultraviolet lamp 22*a* of the magenta fixer 22 is turned on. The recording region provided with the magenta image comes to the position over the magenta fixer 22. The magenta fixer 22 applies ultraviolet rays to the recording sheet 1 to fix the magenta coloring layer 4.

After recording of the magenta image, the recording sheet 1 is successively conveyed, and receives application of the ultraviolet rays for all the recording region. The magenta coloring layer 4 is photochemically fixed. The conveying rollers 11 are rotated in the reverse direction. The recording sheet 1 is conveyed in a backward direction toward the entrance 12*a*. The thermal head 15 has a position away from the recording sheet 1.

When the front edge 1*a* of the recording sheet 1 comes to the nip position of the conveying rollers 11, then the rotational direction of the conveying rollers 11 is changed, to convey the recording sheet 1 forwards toward the exit 12*b*. At the beginning of the conveyance, the beginning edge of the recording region is confronted with the plate-shaped heater 20, which is driven to start operation of the preheating.

When the beginning edge of the recording region after the preheating comes to the recording position, the thermal head 15 applies the reduced heat energy to the recording sheet 1 as a difference obtained by subtracting the remaining heat of the preheating from the sufficient coloring heat energy. The thermal head 15 starts recording the cyan image. In the course of the cyan recording, the recording sheet 1 is moved toward the exit 12*b*. The ultraviolet lamp 22*a* of the magenta fixer 22 is still kept turned on, to apply ultraviolet rays to the rear edge 1*b* of the recording sheet 1 not having received the rays outside the recording region. The rear edge 1*b* is bleached by the rays. Finally recording and fixation of the recording sheet 1 are finished. The recording sheet 1 is exited through the exit 12*b* toward the receptacle tray.

Consequently a full-color image is recorded to the recording sheet 1 without conspicuous decrease in the gloss of the recording surface 6*a* and without remarkable reduction in the density in the image. The preheating is effective in preventing the recording sheet 1 from having high temperature beyond the limit by the virtue of the remaining heat of the preheating occurrence of blisters can be avoided. The quality of the printed sheet is heightened.

In the present embodiment, the preheating device is the plate-shaped heater 20 which incorporates the heating element such as Nichrome wire. It is also possible to use a far infrared radiation heater or halogen lamp as a preheating device. The far infrared radiation heater includes a ceramic heater and a semiconductor heater. Also the preheating device may be an additional thermal head as referred to later.

Figure 6:
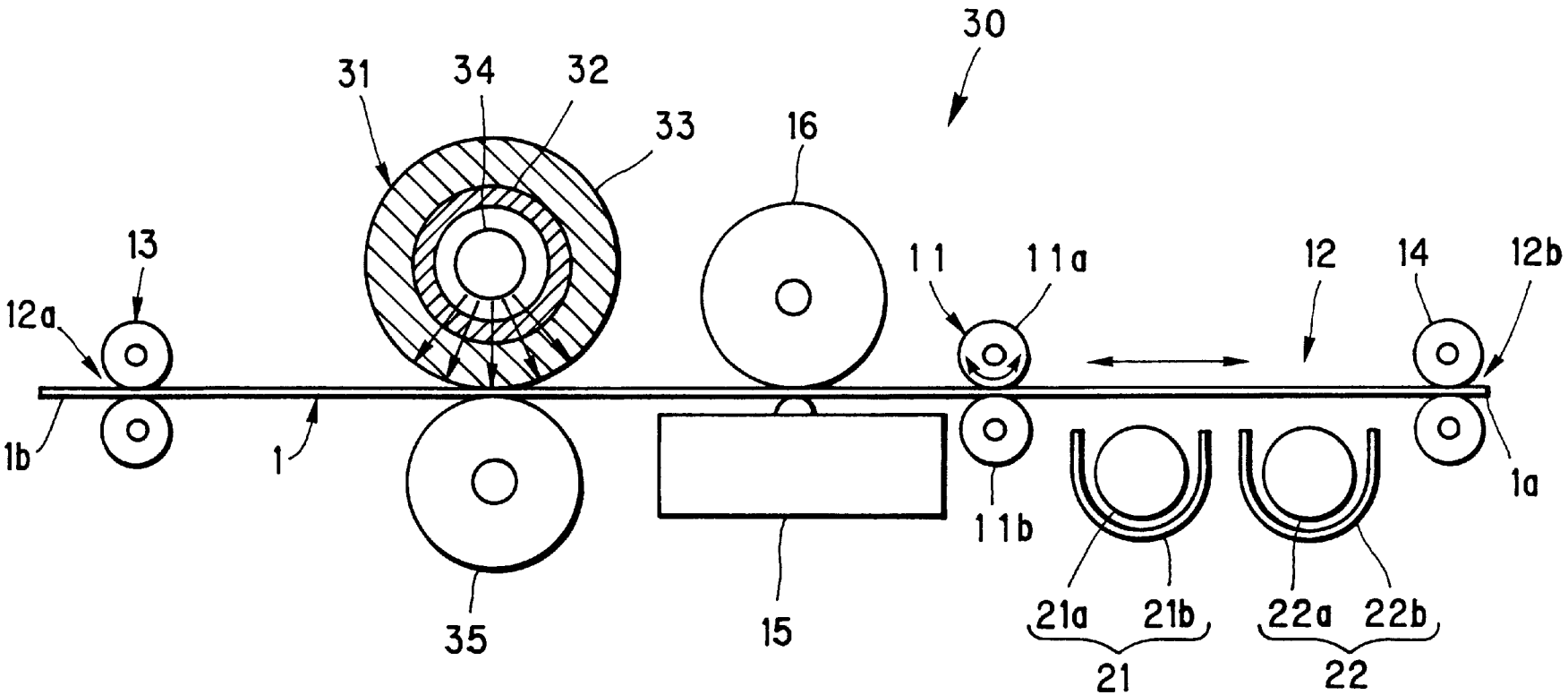
FIG. 6 is an explanatory view in elevation, illustrating a variant thermal printer including a heat roller for preheating.

The preheating device may be a heat roller 31 as illustrated in FIG. 6. The heat roller 31 is constituted of a halogen lamp 34 for generating heat, an aluminum tube 32 surrounding the halogen lamp 34, and a rubber tube 33 covering the aluminum tube 32. Examples of sizes of the heat roller 31, the aluminum tube 32 and the rubber tube 33 are as follows: a diameter of the heat roller 31 is 10 mm; a thickness of the rubber tube 33 is 2 mm; a diameter of the aluminum tube 32 is 6 mm; and a thickness of the aluminum tube 32 is at least 1 mm.

The halogen lamp 34 is not contacted on the inside of the aluminum tube 32. The halogen lamp 34 is fixed on a lamp supporting member (not shown) disposed beside the conveying path 12. The aluminum tube 32 is rotatable, and rotated by movement of the recording sheet 1. There is an auxiliary platen roller 35 confronted with the heat roller 31 to squeeze the recording sheet 1 between it and the heat roller 31. A color thermal printer 30 having those structures operates in a similar manner to the above embodiment. It is also possible instead of the halogen lamp 34 to use a Ni-chrome wire or semiconductor heater.

In the embodiments of FIGS. 3 and 6, the recording sheet 1 is preheated on the side of the support 2 or a back surface, but may be preheated on the side of the recording surface 6*a* of the protective layer 6. The color thermal printer of the embodiments is a one-head/three-pass type in which the recording sheet 1 is moved back and forth rectilinearly and receives application of heat with the one thermal head. The present invention is also applicable to a color thermal printer of a three-head/one-pass type which includes three thermal heads, and in which the recording sheet 1 is moved one time rectilinearly past the thermal heads for the application of heat and also photochemical fixation of the coloring layers. It is desirable in the three-head/one-pass type to dispose the preheating device between the magenta fixer and a cyan printing thermal head, and in a position close to the cyan thermal head.

Figure 7:
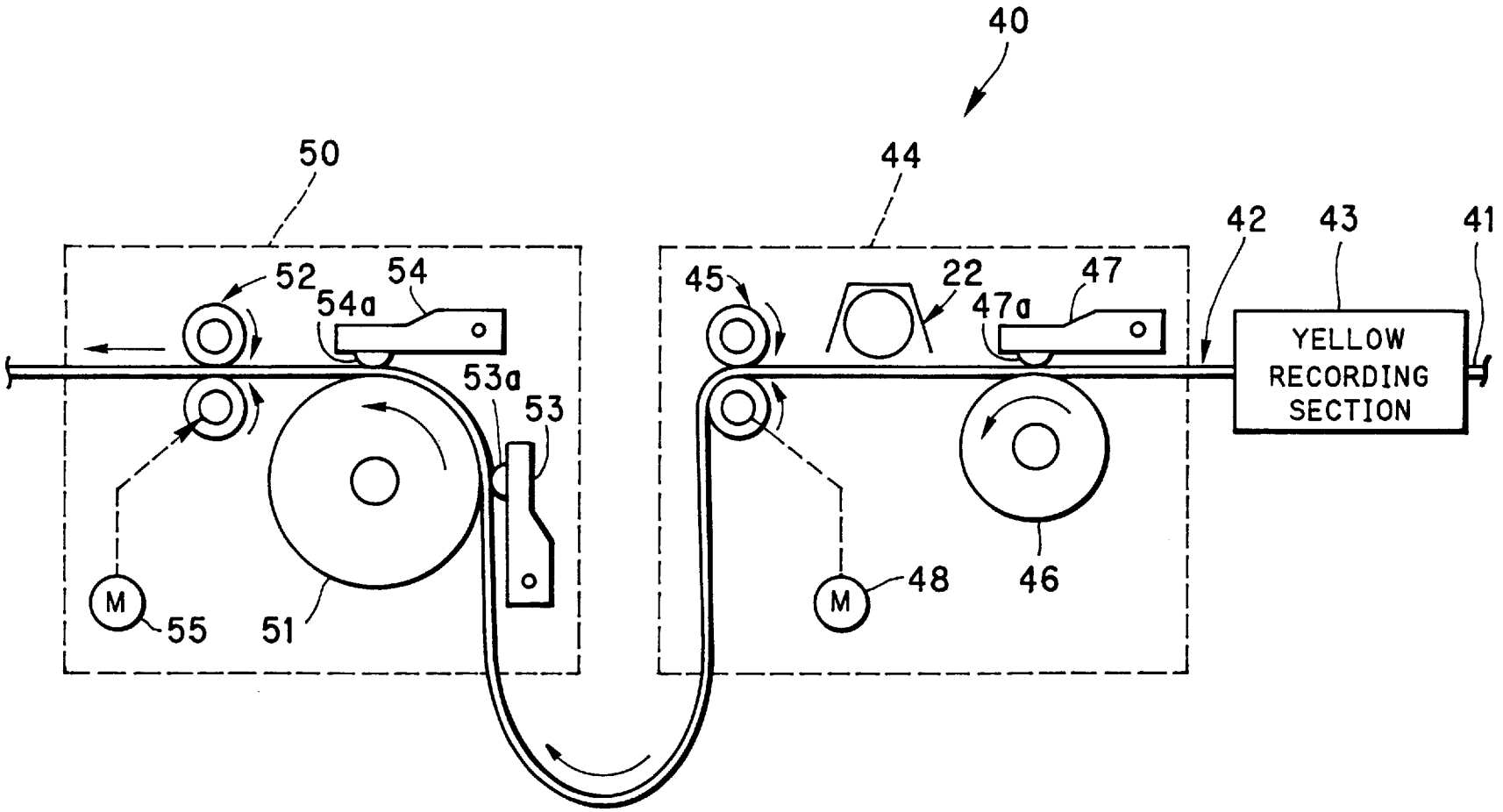
FIG. 7 is an explanatory view in elevation, illustrating another preferred thermal printer in which efficiency in power for the printing is maximized.

FIG. 7 illustrates a preferred embodiment in which efficiency and reliability of the preheating is optimized. Elements similar to those of the above embodiments are designated with identical reference numerals. The present embodiment is directed to a three-head/one-pass type of color thermal printer.

In FIG. 7, a color thermal printer 40 records a fullcolor image to a continuous recording sheet 41 as a color thermosensitive material and unwound from a sheet roll (not shown). There are a plurality of recording regions virtually defined on the recording sheet 41. A full-color image is recorded to each of the recording regions according to a three-color frame-sequential manner. The thermal printer 40 also has a cutter (not shown) which is operated after the image recording. The cutter cuts the recording sheet 41 one recording region from another. A single printed recording sheet having one recording region is exited from the thermal printer 40.

The recording sheet 41 is similar to the recording sheet 1 of FIG. 3, and includes the support 2, the cyan coloring layer 3, the magenta coloring layer 4, the yellow coloring layer 5 and the protective layer 6 disposed in the order listed. The cyan coloring layer 3 has the lowest thermal sensitivity. The cyan coloring layer 3 has such a characteristic that, when the recording sheet 41 is heated on the side of the recording surface 6*a* at the surface temperature of 250° C., the cyan coloring layer 3 has an estimated temperature of 150° C. and starts being colored. The support 2 is WP paper, which consists of paper and coatings of resin applied to both surfaces of the paper.

The recording sheet 41 drawn from the sheet roll is conveyed along a conveying path 42 of FIG. 7 constantly at 16 mm/sec and in a direction from the right toward the left in FIG. 7. There are arranged a yellow recording section 43, a magenta recording section 44 and a cyan recording section 50 along the conveying path 42.

The magenta recording section 44 is constituted by a pair of conveying rollers 45, a platen drum 46, a magenta printing thermal head 47 and the magenta fixer 22. The conveying rollers 45 are driven by a stepping motor 48, and convey the recording sheet 41 at a regular speed. During the conveyance, an array of heating elements 47*a* of the magenta printing thermal head 47 apply heat to the recording sheet 41 to color the magenta coloring layer 4, so that a magenta image is recorded one line after another. The recording sheet 41 after the magenta recording is photochemically fixed by the magenta fixer 22, and conveyed to the cyan recording section 50 by the conveying rollers 45.

The yellow recording section 43 is structurally the same as the magenta recording section 44, and has a yellow printing thermal head which heats the recording sheet 41 to record the yellow image line by line by coloring the yellow coloring layer 5. Immediately after the yellow recording, near ultraviolet rays peaking at 420 nm are applied by the yellow fixer to the recording sheet 41, to fix the yellow coloring layer 5.

The cyan recording section 50 includes a platen drum 51, a pair of conveying rollers 52, a preheating thermal head 53 and a cyan printing thermal head 54. The preheating head 53 and the cyan printing thermal head 54 are confronted with the platen drum 51. The recording sheet 41 is contacted on a portion of one fourth of a circumference of the platen drum 51. When a stepping motor 55 rotates the conveying rollers 52, the recording sheet 41 is conveyed in contact with the platen drum 51.

The preheating head 53 consists of an array of heating elements 53a arranged in line in the main scanning direction which is crosswise to the recording sheet 41. The preheating head 53 is disposed upstream from the cyan printing thermal head 54, and presses the recording sheet 41 against the platen drum 51.

The recording surface 6*a* of the recording sheet 41 is so preheated by the preheating head 53 that temperature Ts (° C.) of the recording surface 6*a* at the cyan printing thermal head 54 is rendered constant to meet:

$$t1-t2 \leqq Ts \text{ and } Tr \leqq Ts;$$

where t1 (° C.) is temperature of the recording surface 6*a* required for coloring the cyan coloring layer 3 at maximum density without preheating; t2 (° C.) is a temperature at which the recording surface 6*a* is thermally damaged, namely bubbles occur on the recording surface 6*a*; and Tr (° C.) is room temperature. Of course the surface temperature Ts meets $Ts \leqq t3$ where t3 is the surface temperature of the recording surface 6*a* at which the cyan coloring layer 3 starts being colored.

The recording sheet 41 has such characteristics that t1 −t2=50° C. and t3=250° C. The recording sheet 41 is preheated up to the surface temperature Ts which is preset in a range between 50° C. and 250° C. An upper limit of the surface temperature Ts is the temperature t3, at which the cyan coloring layer 3 scarcely starts being colored. A surface temperature Tp of the recording surface 6*a* of the recording sheet 41 at the time of the preheating is prevented from coming beyond the temperature t3 for avoidance of coloring the cyan coloring layer 3 in the preheating.

If t1−t2≦Tr, namely if the surface temperature Ts of the recording sheet 41 is higher than the temperature (t1−t2) without the preheating, no preheating operation is effected. But it is necessary to reduce the heat energy from the cyan printing thermal head 54 to the recording sheet 41 in a manner similar to cases having preheating operation.

The cyan printing thermal head 54 is disposed in a position upstream from the conveying rollers 11, and includes an array of a great number of heating elements 54*a* which are arranged crosswise to the recording sheet 41. The heating elements 54*a* record a cyan image line after line. Each of the lines consists of plural pixels, namely plural dots. Each pixel is recorded by one of the heating elements 54*a*. The cyan printing thermal head 54 presses the recording sheet 41 against the platen drum 51.

For cyan recording at the cyan printing thermal head 54, the cyan printing thermal head 54 applies reduced heat energy to the cyan coloring layer 3 after reduction of heat energy by an amount associated with the preheating of the recording sheet 41 at the preheating head 53. Note again that heat supplied by the preheating is inevitably partially lost in the course of the movement to the cyan printing thermal head 54. Therefore the cyan printing thermal head 54 supplies the recording sheet 41 with heat energy as a sum of lost heat energy and the heat energy being set smaller.

In short, a main heating temperature is obtained as "tv−Ts" by subtracting the surface temperature Ts of the recording surface 6*a* after the preheating from the virtual surface temperature "tv" of the recording surface 6*a* for the cyan recording without preheating. The main heating temperature is used to heat the recording sheet 41. Consequently the cyan printing thermal head 54 is prevented from being so hot as to create bubbles in the protective layer 6 or create blisters between the support 2 and the cyan coloring layer 3.

The operation of the alternative construction is described now. The recording sheet 41 is unwound from the sheet roll, and subjected to the yellow recording and yellow fixation in the yellow recording section 43. The recording sheet 41 is then subjected to the magenta recording and magenta fixation in the magenta recording section 44. Then the recording sheet 41 is conveyed into the cyan recording section 50.

In the cyan recording section 50, the heating elements 53*a* of the preheating head 53 and the heating elements 54*a* of the cyan printing thermal head 54 are pressed against the recording sheet 41 about the platen drum 51. The conveying rollers 52 are rotated to convey the recording sheet 41 at a regular speed.

A beginning edge of the recording region comes to the position of the preheating head 53, which is driven and preheats the recording sheet 41. The heating elements 53*a* are energized by a current being predetermined to generate heat. The recording sheet 41 is preheated at the surface temperature Tp, which does not color the cyan coloring layer 3. The recording sheet 41 remains preheated before the ending edge of the recording region moves past the preheating head 53.

The preheated portion of the recording sheet 41 is conveyed toward the cyan printing thermal head 54 by rotation of the conveying rollers 52. The platen drum 51 is rotatable by movement of the recording sheet 41, and is rotated by the virtue of the conveying rollers 52. When the front edge of the recording region moves to the recording position, the cyan printing thermal head 54 starts recording a first one of the lines of a cyan image. The heating elements 54*a* generate heat at the main heating temperature which is determined as (tv−Ts) by subtracting the surface temperature Ts of the recording surface 6*a* after the preheating from the virtual surface temperature tv of the recording surface 6*a* for the cyan recording without preheating. The recording sheet 41 is provided with heat energy under the main heating temperature. Coloring heat energy according to coloring density at which pixels of the first line should be colored is applied to the recording sheet 41, to record the first line by develop color of the cyan coloring layer 3.

If the cyan coloring layer 3 is desired to be colored at the maximum density for example, the heating elements of the cyan printing thermal head 54 generates heat at temperature (t1−Ts). Considering the surface temperature Ts meeting Ts ≧t1−t2, the temperature (t1−Ts) is necessarily equal to or smaller than the temperature t2 at which the recording surface 6*a* is thermally damaged. The recording surface 6*a* of the recording sheet 41 on the top of the protective layer 6 is kept from being higher than the temperature t2 when in contact with the heating elements. No bubbles are created in the protective layer 6. It is possible to avoid creating blisters, because the recording sheet 41 does not have such a high temperature as without the preheating.

After the recording of the first line, a second line and succeeding lines are recorded successively. The recording sheet 41 with the three-color images recorded thereon is conveyed further past the conveying rollers 52, and cut between recording regions, so that each of the printed recording sheets is exited from the printer.

Figure 8:
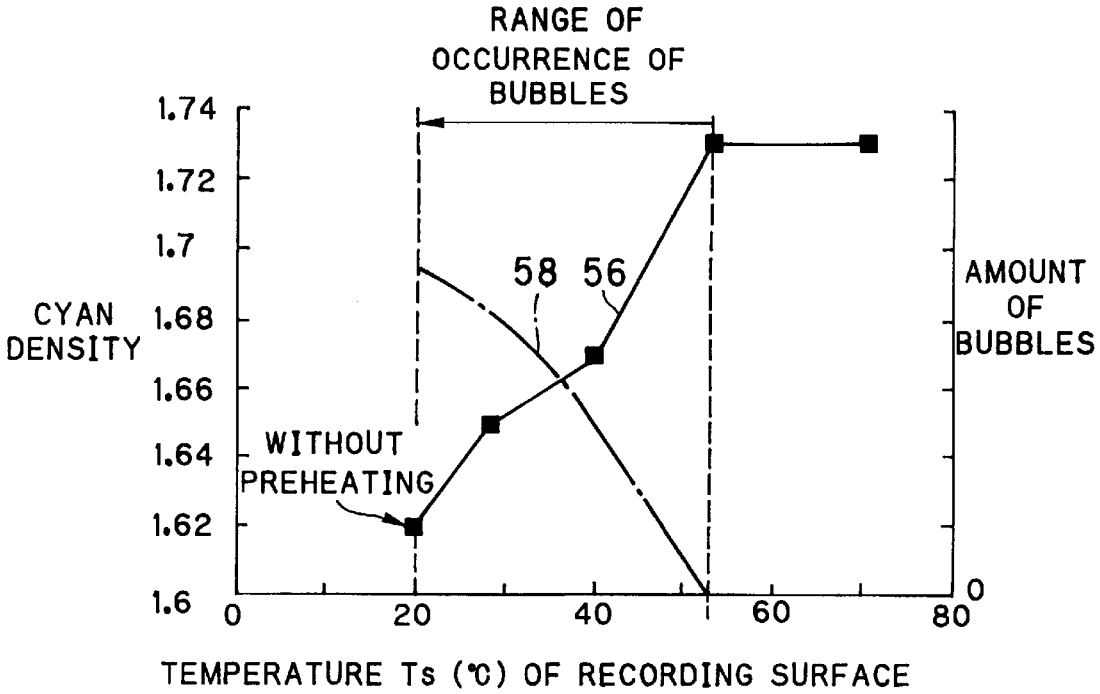
FIG. 8 is a graph illustrating relationships between surface temperature of the recording sheet, cyan coloring density, and an amount of bubbles.

FIG. 8 is a graph showing relationships between the surface temperature Ts, actual cyan density and an amount of bubbles. The actual cyan density is obtained as not less than maximum cyan density when heat energy for the maximum cyan density is applied to the cyan coloring layer 3. In FIG. 8, a zigzag line 56 with the square dots indicates the actual cyan density. A phantom line 58 indicates the amount of bubbles.

Figure 9:
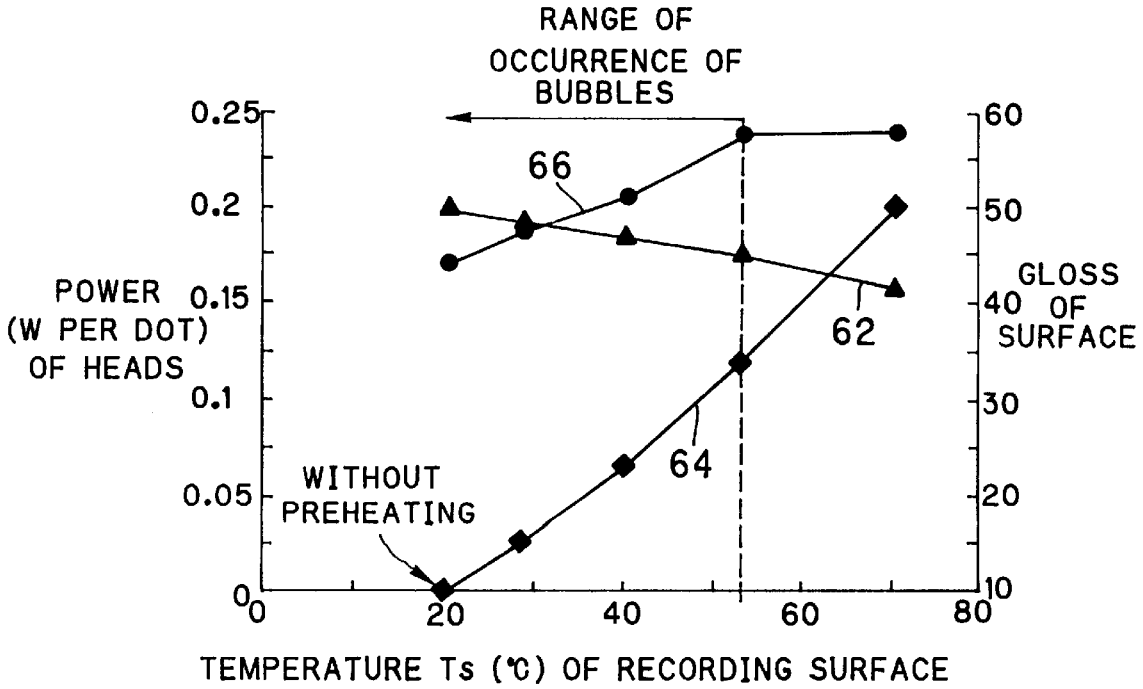
FIG. 9 is a graph illustrating relationships between the surface temperature, gloss of the recording sheet, and power consumed by a cyan coloring thermal head and a preheating thermal head.

FIG. 9 is a graph showing relationships between the surface temperature Ts, consumed power of the preheating head 53 and the cyan printing thermal head 54, and gloss of the recording surface 6*a* of the continuous recording sheet 41, assuming that the cyan coloring layer 3 is colored at commonly given density of 1.68 by the cyan printing thermal head 54. In FIG. 9, a line 62 with the triangular dots indicates consumed power of the cyan printing thermal head 54. A line 64 with the square dots indicates consumed power of the preheating head 53. A line 66 with the circular dots indicates the gloss of the recording surface 6*a*. Note that the continuous recording sheet 41, the preheating head 53 and the cyan printing thermal head 54 related to FIGS. 8 and 9 have a condition where the continuous recording sheet 41 is conveyed at the speed of 16 mm/sec, the preheating head 53 is 22 mm before the cyan printing thermal head 54, and the room temperature is 20° C.

As a result, the amount of bubbles decreases and the cyan density increases according to the surface temperature Ts in the position of the cyan printing thermal head 54. According to the decrease of the bubbles, the gloss increases. When the surface temperature Ts is 50° C. or more, no bubbles occur, and the cyan density becomes constant and stable. Occurrence of no bubbles results in stability in the gloss of the recording surface 6*a*. It follows that the virtual temperature t1 is higher than the temperature t2 by approximately 50° C., where t1 is the virtual surface temperature of the recording surface 6*a* for the cyan recording without preheating, and t2 is the surface temperature of the recording surface 6*a* at which the recording surface 6*a* is thermally damaged. It is concluded that the continuous recording sheet 41 can be preheated to avoid occurrence of bubbles and avoid drop of coloring density by rendering the surface temperature Ts to be 50° C. (=t1=t2) or higher.

As shown in FIG. 9, the consumed power of the preheating head 53 is higher according to highness of the surface temperature Ts. But the consumed power of the cyan printing thermal head 54 is lower. The temperature of the continuous recording sheet 41 is lowered by a heat loss in conveyance after the preheating. The sum of the consumed power of the preheating head 53 and the consumed power of the cyan printing thermal head 54 is higher than the power that the cyan printing thermal head 54 would consume without the preheating. It is concluded that the surface temperature Ts is set Ts=t1−t2 the most desirably, and specifically Ts=50° C., in view of maximizing efficiency as a result of the minimized total of the consumed power and at the same time the greatest extent of improving the sheet gloss and reproduced density.

It is to be noted that, in spite of the condition of the surface temperature Ts (° C.) for the preheating $$t1-t2 \leqq Ts$$

it is possible to determine a lower limit of the surface temperature Ts in a different manner based on at least one of t1 and t2. A lower limit of the surface temperature Ts can be determined in any different manners irrespective of t1 and t2 but depending upon characteristics of the recording sheet 41. In the formula "t1−t2≦Ts", t1, t2 and Ts are in the unit of degrees centigrade. If units other than centigrade is desired for t1, t2 and Ts, it is of course possible to rewrite the formula in a form expressed commonly to the different units as "t1−t2+MPw≦Ts, where MPw is a melting point of water (=0° C.).

In the embodiment, the preheating head 53 generates the preheating energy as previously obtained suitably. To obtain the same, the following experimental process is used. In the preheating station, the preheating head 53 heats the recording surface 6*a* of the recording sheet 41 at a test preheating temperature of one value. After heating at the test preheating temperature, the cyan printing thermal head 54 applies heat energy to the recording surface 6*a* of the recording sheet 41 as heat energy determined for coloring the cyan coloring layer 3 at a target high density, which is for example maximum density of the cyan coloring layer 3. If the cyan coloring layer 3 of the recording sheet 41 heated by the cyan printing thermal head 54 is colored safely at the target high density without occurrence of thermal damage, it is detected that the test preheating temperature is sufficiently high, and is determined as preheating temperature at which the preheating head 53 is driven to generate the preheating energy.

To maximize efficiency of the preheating, the preheating temperature is determined minimally. Specifically, a plurality of sufficiently high values of the test preheating temperature are obtained experimentally. Among the plural sufficiently high values, a smallest one is selected. It is therefore possible to reduce a loss of heat in the recording sheet 41 between the preheating and the thermal recording.

Figure 10:
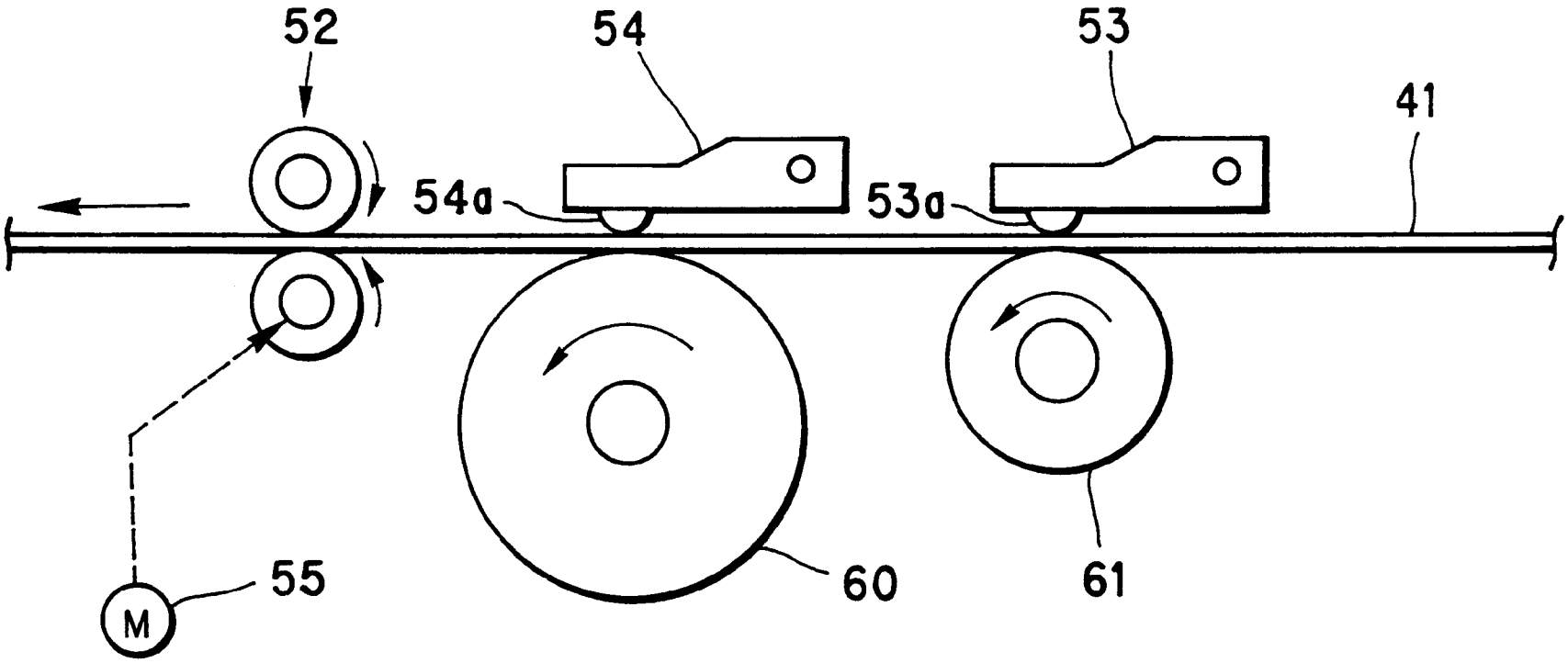
FIG. 10 is an explanatory view in elevation, illustrating a variant thermal printer including an additional platen roller for the preheating head separately from a main platen roller for the cyan coloring thermal head.

In the above embodiments, the cyan printing thermal head 54 and the preheating head 53 are confronted with the platen drum 51. The present invention is also applicable to a thermal printer of FIG. 10 in which there are disposed platen rollers 60 and 61 respectively associated with the cyan printing thermal head 54 and the preheating head 53. Elements similar to those of the above embodiments are designated with identical reference numerals.

In the above embodiments, the preheating head 53 has the great number of heating elements 53*a*, but may consist of a single heating element of a long shape crosswise to the continuous recording sheet 41. The heating elements 53*a* can be as numerous as the heating elements 54*a*, or less than the heating elements 54*a*. It is possible to include two arrays of preheating heating elements and recording heating elements in a single thermal head. Also the plate-shaped heater 20 and the heat roller 31 of FIGS. 3 and 6 may be used. The continuous recording sheet 41 may be preheated on the side of the back surface, or on both sides of the back surface and the recording surface 6*a*. The preheating temperature is minimized in view of preventing bubbles in coloring the cyan coloring layer 3 at the maximum density in consideration of the temperatures t1 and t2 and the like. Thus the preheating is maximized in efficiency.

The deepest coloring layer closest to support 2 is the cyan coloring layer 3. An alternative recording sheet may have either of a yellow coloring layer and a magenta coloring layer as a deepest coloring layer closest to the support 2. In either of the alternative recording sheets, the present invention is applicable in preheating the deepest coloring layer.

In the above embodiment, the recording sheet 1, 41 is preheated before the cyan recording. It is further possible to preheat the recording sheet 1, 41 before the yellow recording and/or before the magenta recording. Of course the temperature of preheating before the yellow and/or magenta recording should be lower than a range of coloring of the yellow coloring layer 5 and/or the magenta coloring layer 4.

The thermal printer above is a color thermal printer. Of course the present invention is applicable to a monochromatic thermal printer.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A thermal printing method in which thermosensitive recording material is conveyed relative to a thermal head, and has a recording surface contacted on said thermal head, and said thermal head applies heat energy to said recording material to record an image on said recording material, said thermal printing method comprising the steps of:

providing a platen roller confronting said thermal head;

providing a preheating device; and preheating said recording material with said preheating device shortly before recording of said recording material with said thermal head by applying a preheating energy lower than enough to color said recording material, but high enough to heightening temperature of said recording material upon relative movement of said recording material to said thermal head, whereby said heat energy to be applied by said thermal head is reduced according to said preheating energy, wherein said preheating step causes said recording surface to have surface temperature Ts upon relative movement of said recording material to said thermal head, said surface temperature Ts meeting:

Ts≧50° C.;

t1−t2≦Ts; and

Tr≧Ts;

where t1 is a temperature of said recording surface for coloring said recording material at maximum density thereof without said preheating step;

t2 is a temperature of said recording surface at which said recording surface is thermally damaged; and Tr is room temperature.

2. The thermal printing method as defined in claim 1, further comprising the steps of conveying said recording material along a conveying path, and performing said preheating step in a preheating station disposed upstream from said thermal head.

3. The thermal printing method as defined in claim 2, further comprising the step of performing said preheating step on a back surface of said recording material opposite to said recording surface.

4. The thermal printing method as defined in claim 2, further comprising the step of performing said preheating step on said recording surface.

5. The thermal printing method as defined in claim 1, further comprising the step of contacting said recording material with said preheating device during said preheating step.

6. The thermal printing method as defined in claim 1, further comprising the step of providing a second platen roller confronting said preheating device.

7. A thermal printing method in which thermosensitive recording material is conveyed relative to a thermal head, and includes a support and at least first, second and third thermosensitive coloring layers arranged on said support and colorable in different colors, said first thermosensitive coloring layer is disposed with a recording surface of said recording material and has a highest thermal sensitivity, and said third thermosensitive coloring layer is disposed close to said support and has a lowest thermal sensitivity, said thermal head applies heat energy to said first, second and third thermosensitive coloring layers, and then electromagnetic rays are applied to said first and second thermosensitive coloring layers for fixation thereof, said thermal printing method comprising the steps of:

preheating said recording material with preheating energy after recording of said second thermosensitive coloring layer with said thermal head and shortly before recording of said third thermosensitive coloring layer with said thermal head, said preheating energy being lower than enough to color said third thermosensitive coloring layer, but high enough to heightening temperature of said third thermosensitive coloring layer upon relative movement of said recording material to said thermal head, whereby said heat energy to be applied by said thermal head is reduced according to said preheating energy;

conveying said recording material along a conveying path; and performing said preheating step in a preheating station disposed upstream from said thermal head, wherein said preheating step causes said recording surface to have surface temperature Ts upon relative movement of said recording material to said thermal head, said surface temperature Ts meeting:

$Ts \geqq 50°$ C.;

$t1-t2 \leqq Ts$; and $Tr \leqq Ts$;

where t1 is a temperature of said recording surface for coloring said recording material at maximum density thereof without said preheating step;

t2 is a temperature of said recording surface at which said recording surface is thermally damaged; and Tr is room temperature.

8. The thermal printing method as defined in claim 6, further comprising the step of performing said preheating step on a back surface of said recording material opposite to said recording surface.

9. The thermal printing method as defined in claim 6, further comprising the step of performing said preheating step on said recording surface.

10. The thermal printing method as defined in claim 6, further comprising the steps of:

providing a platen roller confronting said thermal head; and providing a preheating device confronting said platen roller for performing said preheating step.

11. The thermal printing method as defined in claim 7, further comprising the steps of:

providing a preheating device in said preheating station; and contacting said recording material with said preheating device during said preheating step.

12. The thermal printing method as defined in claim 7, further comprising the steps of:

providing a preheating device in said preheating station;

providing a first platen roller confronting said thermal head; and providing a second platen roller confronting said preheating device.

13. A thermal printer, having a thermal head, and in which a recording surface of thermosensitive recording material is contacted on said thermal head while said recording material is conveyed along a conveying path, said recording material including a support and at least first, second and third thermosensitive coloring layers arranged on said support and colorable in different colors, said first thermosensitive coloring layer being disposed with said recording surface of said recording material and has a highest thermal sensitivity, and said third thermosensitive coloring layer being disposed close to said support and has a lowest thermal sensitivity, and said thermal head applies heat energy to said first, second and third thermosensitive coloring layers to record an image on said recording material, said thermal printer comprising:

a preheating device, disposed upstream from said thermal head on said conveying path and close to said thermal head, for preheating said recording material with preheating energy which causes said recording surface to have surface temperature Ts upon movement of said recording material to said thermal head, said surface temperature Ts meeting:

$Ts \geqq 50°$ C.;

$t1-t2 \leqq Ts$; and $Tr \leqq Ts$;

where t1 is a temperature of said recording surface for coloring said third thermosensitive coloring layer at maximum density thereof without said preheating device;

t2 is a temperature of said recording surface at which said recording surface is thermally damaged; and Tr is room temperature, whereby said heat energy to be applied by said thermal head is reduced according to said preheating energy.

14. The thermal printer as defined in claim 13, wherein said recording material has a back surface opposite to said recording surface, and said preheating device confronts and preheats said back surface.

15. The thermal printer as defined in claim 13, wherein said preheating device preheats said recording surface.

16. The thermal printer as defined in claim 15, further comprising a platen roller which is disposed on said conveying path, and with which said preheating device and said thermal head are confronted, said platen roller supporting said recording material during preheating and said thermal recording.

17. The thermal printer as defined in claim 13, wherein said preheating device is a plate-shaped heater or a preheating thermal head.

18. The thermal printer as defined in claim 12, further comprising:

a first platen roller, disposed on said conveying path and confronted with said thermal head, for supporting said recording material during said thermal recording; and a second platen roller, disposed on said conveying path and confronted with said preheating device, for supporting said recording material during preheating.

19. Th e thermal printer as defined in claim 13, wherein said preheating device is a rotatable heat roller.

* * * * *